United States Patent [19]

Zilver

[11] 3,934,832

[45] Jan. 27, 1976

[54] REEL ASSEMBLY FOR ROLLER

[75] Inventor: Edwin Zilver, Doorwerth, Netherlands

[73] Assignee: Intersilma B.V., Velp, Netherlands

[22] Filed: Jan. 20, 1975

[21] Appl. No.: 542,556

Related U.S. Application Data

[63] Continuation-in-part of Ser. No. 406,468, Oct. 15, 1973, abandoned.

[30] Foreign Application Priority Data

Oct. 18, 1972 Netherlands ..... 7214127

[52] U.S. Cl. ..... 242/54 R; 160/319; 242/106

[51] Int. Cl.[2] ..... B65H 75/00; E06B 9/20

[58] Field of Search ..... 242/54 R, 106, 100; 160/319

[56] References Cited

UNITED STATES PATENTS

| | | | |
|---|---|---|---|
| 332,299 | 12/1885 | Stewart | 160/319 |
| 559,098 | 4/1896 | Davies | 160/319 X |
| 816,820 | 4/1906 | Pouliot | 160/319 |
| 1,325,401 | 12/1919 | Humphreys | 160/319 X |
| 2,172,459 | 9/1939 | Smith | 242/106 X |

FOREIGN PATENTS OR APPLICATIONS

| | | | |
|---|---|---|---|
| 285 | 7/1877 | Germany | 160/319 |
| 1,600 | 6/1877 | United Kingdom | 160/319 |

*Primary Examiner*—Stanley N. Gilreath
*Attorney, Agent, or Firm*—Norris & Bateman

[57] ABSTRACT

To prevent the pull cord for a roller blind or the like from jumping off its reel or pulley and becoming entangled, the reel is enclosed within a loosely mounted tubular member which closely peripherally surrounds the end flanges on the reel and maintains a substantial coaxial relation therewith with a clearance less than the thickness of the pull cord and is provided with an aperture through which the free end of the pull cord can pass. To prevent the cord from chafing against the edges of the aperture an external guide for the cord is preferably provided which prevents the cord, when taut, from touching the edges of the aperture.

8 Claims, 2 Drawing Figures

REEL ASSEMBLY FOR ROLLER

Figure 1:
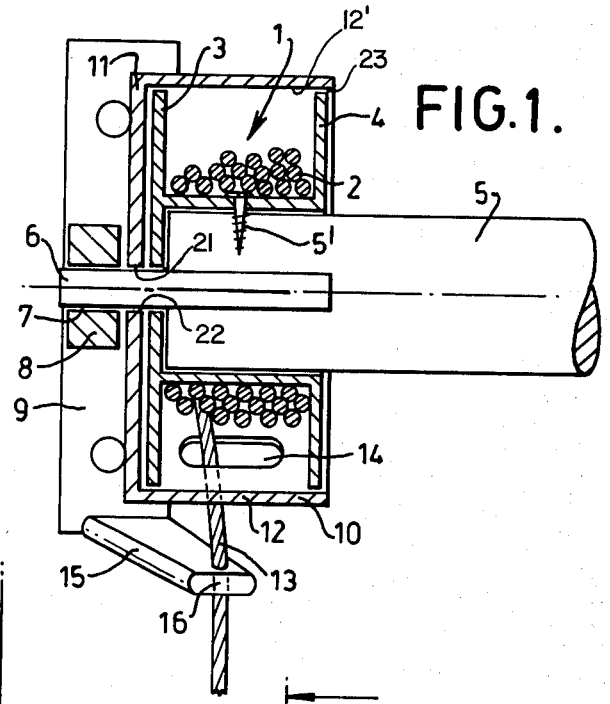

This is a continuation-in-part of my copending application Ser. No. 406,468 filed Oct. 15, 1973, now abandoned.

This invention relates to reels of the kind which are adapted to be mounted on a fixed support for rotation relative to said support by a pull cord secured at one end to the reel. Such reels are already widely used for the pull cords of roller blinds, venetian blinds and the like.

A difficulty which may occur when operating the pull cord of a blind, curtain or the like is that when the cord is jerked it may jump off the reel and become entangled. Because such reels are usually mounted in an elevated position it is necessary to climb to disentangle the cord.

It has been proposed, as disclosed in such prior art as British Pat. No. 1600 dated Apr. 24, 1877 and German Patent No. 285 dated July 15, 1877 to attach the pull cord to a pulley or reel fixed on the end of a reel or roller blind, and to substantially enclose the pulley by a generally cylindrical casing that is fixed to the wall or adjacent support.

A problem encountered in such structure has been the tendency of the pull cord to pass over the outer periphery of the pulley and become jammed between the pulley and the casing. It was at first believed that merely increasing the diameter of the pulley flanges to dispose the flange peripheries close to the inner surface of the casing would solve the problem, but since rollers of this type are normally not mounted to rotate on accurately maintained axes this proposed solution was not successful in that it often resulted in frictional binding between the fixed casing and the pulley flanges.

The invention solves the problem by providing a loose floating mount for a tubular member or casing extending over the pulley. This enables the tubular member to have an internal surface very close to the flange periphery diameters, the distance being less than the size of the pull cord, while at the same time eliminating the need for accurate dimensions. The tubular member by reason of its ability to float with the pulley maintains itself at all times substantially coaxial with the pulley and maintains the distance between the internal surface of the tubular member and the flange peripheries at all points less than the thickness of the pull cord; and the loose fit of a pin on the tubular member in an opening in the support permits the slight tilting, radial and axial movements of the tubular member while adequately restraining member 10 from free rotation about the axis of the roller blind.

The present invention thereby provides a mechanically simple but unexpectedly efficient means for preventing the inconveniences of the prior art.

The invention is thus characterized by a loosely mounted tubular member which during operation maintains a substantially coaxial relation with the reel or pulley while closely surrounding the outer peripheries of the end flanges of the reel and is provided with an aperture for the passage of the free end of the pull cord.

Because the tubular member closely surrounds the reel flanges the pull cord is confined within an annular space surrounding the reel and bounded by the internal surface of the tubular member and hub and the flanges and can only leave the reel through the aperture. This means that in the invention it is not possible for loops of cord to jump off the reel. Experience has shown that even if the pull cord is jerked no difficulties will occur in raising or lowering the blind.

The tubular member is preferably loosely mounted on a trunnion of the blind roller to which the reel or pulley is secured and means provided for preventing the tubular member from freely rotating with the reel. This may consist of a removable pin which loosely connects the tubular member to a fixed support for the trunnion.

The size of the aperture through which the cord leaves the reel is dependent upon the thickness of the cord and in order to keep this aperture as small as possible without causing excessive wear of the cord through contact with the edges of the aperture it is preferred to provide an external guide adjacent the aperture which ensures that when the cord is taut it will pass through the aperture without contacting the edges. The aperture, however, can be quite large compared with the thickness of the cord without the danger of a loop of the cord being able to slip therethrough.

Figure 2:
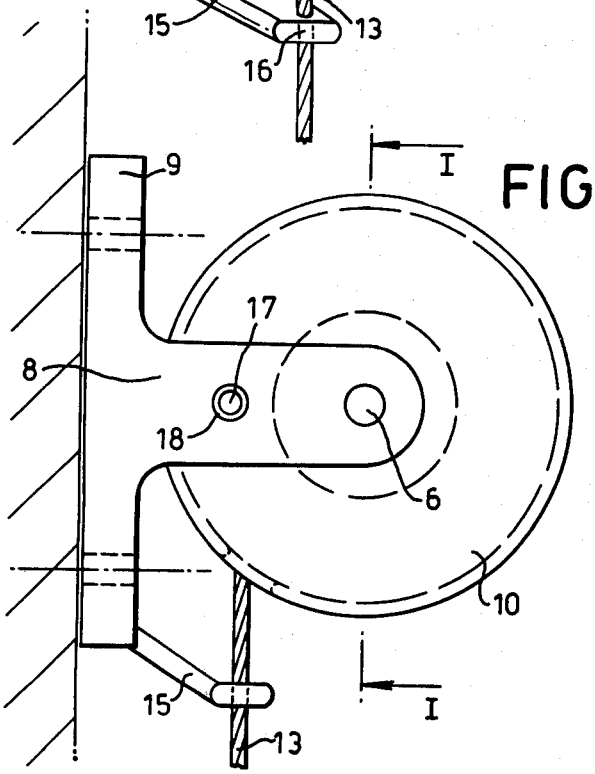

One embodiment of the invention is illustrated in the accompanying drawing, in which:

FIG. 1 is an axial section through the reel and of a roller blind according to a preferred embodiment of the invention, taken along the line I–I of FIG. 2; and FIG. 2 is an end view of the device shown in FIG. 1.

In the drawing, 1 designates a reel or pulley having a hub 2, a flange 3 and a flange 4. The reel flanges are shown as having circular outer peripheries of the same diameter. The reel 1 is fixedly mounted on a roller 5 coaxial with the hub 2 and rotation of the reel relative to the roller is prevented by a screw 5'. A trunnion 6 comprising an extension of the roller 5 passes freely through the flange 3 as shown and is journalled in an aperture 7 in an arm 8 of a fixed supporting bracket 9 which can be secured by means of screws (not shown) to a wall, window frame or the like.

A tubular member 10 is loosely mounted about the trunnion 6 and comprises a radial portion 11 and a cylindrical portion 12 the inner cylindrical surface 12' of which closely surrounds the flanges 3 and 4 and extends axially a distance at least equal to the length of the reel, and combines with them to define an annular space around the hub 2 to accomodate a cord 13. The tubular member 10 is formed with an aperture 14 for the passage of the cord 13 which is also guided through an eye 16 formed in an arm 15.

In order to prevent it from freely rotating about the trunnion 6, while permitting it to maintain operative association with the pulley flanges, the tubular member 10 is provided with a pin 17 which projects loosely through a larger diameter hole 18 (FIG. 2) in the arm 8.

It is not necessary for the portion 12 of the tubular member 10 to be cylindrical, although such is preferable. It is also for example possible for one of the flanges 3, 4 to be of larger diameter than the other in which case the inner surface of portion 12 would converge somewhat conically from the larger flange towards the smaller flange.

Also, to prevent rotation of the tubular member 10, any other suitable means may be employed in place of the registering pin 17 and hole 18, e.g. a protrusion and notch, a pair of protrusions on opposite sides of the arm 8 or registering flats on the tubular member and its fixed supporting means.

Referring to the drawing, it will be noted that the aforesaid loose mounting of the tubular member 10 comprises a definite clearance 21 shown in FIG. 1 between the cylindrical central opening 22 in the radial side portion 11 of the tubular member where it surrounds trunnion 6; and a definite clearance 23 shown in FIG. 1 between the generally circular outer peripheries of the pulley flanges 3, 4 and the internal cylindrical surface 12' of member 10. The clearance at 23 is smaller than the thickness of pull cord 2. Also, as shown in FIG. 2 the cylindrical pin 17 on the radial portion of member 10 extends with a definite loose fit clearance into the much larger diameter opening 18 in the bracket.

By reason of these clearances the tubular member 10 is free to follow small, and sometimes unavoidable in commercial practice, deviations in the shape and mounting of the pulley, as well as random pulley movements during operation as the roller is turned, and this factor is of crucial importance in that it keeps the distance between the reel flange peripheries and the inner surfaces of the tubular member always reliably smaller than the pull cord thickness regardless of small inaccuracies of dimensions and alignment of the reel, all without the need for excessive accuracy in mounting the reel or the establishment of the very close tolerances that would be necessary if member 10 were fixed relative to the reel to avoid jamming and high friction binding between the reel pulley and the member 10.

In practice it has been observed that the essentially floating loosely mounted tubular member 10 is free to follow small changes in angularity of the reel axis as by tilting relative to the support with accompanying small radial and axial displacements so as to follow the disposition of the pulley and at all times maintain a substantially frictionless but efficient closure of the annular space between the reel hub and the flanges and the tubular member 10. Additionally the member 10 is preferably of light weight, usually a plastic shell, so that it has no inertial or weight problems in following the pulley.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by letters Patent is:

1. In combination with a blind roller rotatably mounted at opposite ends on a fixed support, a reel hub coaxially and fixedly secured to one end of said roller, axially spaced radial end flanges on the hub, a pull cord secured at one end to the reel adapted to be wound onto the hub and adapted to rotate the reel and the roller relative to said support, a tubular member substantially coaxial with the roller and having an inner circumferential surface extending axially for a distance at least equal to the length of said reel substantially closely surrounding the outer peripheries of both said end flanges, the diameter of said flanges being smaller than the diameter of the inner circumferential surface of said tubular member by a small distance less than the thickness of the pull cord, said tubular member having an aperture permitting free and unfettered passage of the unsecured end of the pull cord through said tubular member, and means for loosely mounting said tubular member on said support comprising cooperating means connected to said tubular member and to said support for preventing free rotation of said tubular member about the axis of said roller but allowing small free axial, radial and tilting movements of said tubular member with respect to said support during rotation of said roller.

2. In the combination defined in claim 1, said tubular member having a cylindrical inner surface and said flanges having outer circular peripheries of substantially the same diameter.

3. In the combination according to claim 1, said tubular member being substantially closed at one end by a radial portion which has a central opening loosely surrounding said one end of the roller, and said cooperating means includes loosely interfitting pin and hole means on said fixed support and said radial portion for preventing the tubular member from freely rotating with said roller while permitting said movements of the tubular member relative to said support.

4. In the combination according to claim 1 said tubular member being substantially closed at one end by an annular portion thereof which is loosely mounted on a trunnion projecting from said one end of the roller and journalled in said fixed support.

5. In the combination according to claim 5, said cooperating means for preventing rotation of said tubular member comprising a pin on said tubular member which projects loosely into a hole in the fixed support.

6. In the combination defined in claim 1, said fixed support at the reel end of said roller comprising a bracket secured to a wall or the like and having an opening rotatably receiving the end of said roller, and said cooperating means comprising an axially extending projection on said tubular member fitting with substantial clearance in a further opening in said bracket.

7. In the combination defined in claim 1, said tubular member being a lightweight shell.

8. In the combination according to claim 1, a fixed guide through which the pull cord passes from said aperture, said guide being so positioned in relation to said aperture that the cord, when taut, is prevented from coming into contact with the edges of the aperture.

* * * * *